US009027488B2

(12) United States Patent
Chuo

(10) Patent No.: US 9,027,488 B2
(45) Date of Patent: May 12, 2015

(54) DIRECT DRIVE CLOTH FEEDING MECHANISM OF SEWING MACHINE

(71) Applicant: Shing Ray Sewing Machine Co., Ltd., New Taipei (TW)

(72) Inventor: Jui-Jung Chuo, New Taipei (TW)

(73) Assignee: Shing Ray Sewing Machine Co., Ltd, New Taipei (TW)

( * ) Notice: Subject to any disclaimer, the term of this patent is extended or adjusted under 35 U.S.C. 154(b) by 0 days.

(21) Appl. No.: 14/044,235

(22) Filed: Oct. 2, 2013

(65) Prior Publication Data

US 2015/0090167 A1 Apr. 2, 2015

(51) Int. Cl.
*D05B 27/02* (2006.01)
*D05B 27/22* (2006.01)

(52) U.S. Cl.
CPC ..... *D05B 27/22* (2013.01)

(58) Field of Classification Search
CPC ..... D05B 27/00; D05B 27/02; D05B 27/04; D05B 27/06; D05B 27/08; D05B 27/24; D05B 27/22; D05B 69/00
USPC ..... 112/320–324
See application file for complete search history.

(56) References Cited

U.S. PATENT DOCUMENTS

| | | | | | |
|---|---|---|---|---|---|
| 3,527,183 | A | * | 9/1970 | Szostak et al. | 112/323 |
| 4,019,450 | A | * | 4/1977 | Adams | 112/323 |
| 4,559,887 | A | * | 12/1985 | Sano | 112/455 |
| 4,756,263 | A | * | 7/1988 | Sano | 112/315 |
| 4,958,580 | A | * | 9/1990 | Asaba et al. | 112/314 |
| 5,195,442 | A | * | 3/1993 | Meier | 112/475.19 |

* cited by examiner

*Primary Examiner* — Ismael Izaguirre
(74) *Attorney, Agent, or Firm* — Muncy, Geissler, Olds & Lowe, P.C.

(57) ABSTRACT

A direct drive cloth feeding mechanism of a sewing machine includes a cloth feeding structure, a vertical driving structure and a direction adjustment structure. The cloth feeding structure includes a swing shaft and a cloth feeding teeth member. The vertical driving structure includes an eccentric shaft connected to the cloth feeding teeth member, and an eccentric cam disposed on the eccentric shaft. The direction adjustment structure includes a stepping motor, and a rotating shaft driven by the stepping motor to rotate and switch between a first position and a second position. When the stepping motor directly drives the rotating shaft to the first position, the cloth feeding teeth member performs a forward feeding process. When the stepping motor directly drives the rotating shaft to the second position, the cloth feeding teeth member performs a reverse feeding process.

1 Claim, 5 Drawing Sheets

DIRECT DRIVE CLOTH FEEDING MECHANISM OF SEWING MACHINE

FIELD OF THE INVENTION

The present invention relates to a cloth feeding mechanism of a sewing machine, and particularly to a direct drive cloth feeding mechanism of a sewing machine.

BACKGROUND OF THE INVENTION

In a conventional sewing machine, to meet sewing requirements, processes of sewing forward or sewing in reverse are frequently performed. Such processes are also commonly known as forward stitch and backstitch. The above sewing machine generally uses a single power source for controlling the change of direction of a structure to meet the requirements of forward stitch and backstitch. In a conventional backstitch transmission mechanism, a lever is manually moved to actuate a transmission element, a cloth feeding teeth member is driven by rotation of a transmission shaft, and a fabric is then forwarded or reversed by a rough surface of the cloth feeding teeth member, so as to backstitch the fabric. However, the above operation not only is time consuming, an operator also needs to constantly press the lever. As such, the operator may be further burdened in a way that work efficiency of the operator is lowered to fail in meeting economical considerations.

Therefore, the technique of incorporating connecting rods with an electromagnet is proposed for driving the backstitch transmission mechanism to achieve automatic backstitch. In the above structure, a plurality of connecting rods are coupled with and driven by the electromagnet, and the transmission element is controlled by the connecting rods. Although automatic backstitch is achieved through controlling the connecting rods with the electromagnet, such mechanism for controlling the cloth feeding teeth member to perform forward stitch and backstitch is rather complicated. Further, due to loosening or poor assembly of the connecting rods between the electromagnet and the transmission element, incorrect transmission may be generated. In addition, the above indirect driving mechanism through the connecting rods and the electromagnet is incapable of precisely controlling a rotation angle of the transmission element, such that precise movement of the cloth feeding teeth member may not be controlled precisely neither.

SUMMARY OF THE INVENTION

Therefore the primary object of the present invention is to overcome the problem of insufficient transmission precision in a backstitch structure of a conventional sewing machine.

To achieve the above object, a direct drive cloth feeding mechanism of a sewing machine is provided. The direct drive cloth feeding mechanism includes a cloth feeding structure, a vertical driving structure and a direction adjustment structure. The cloth feeding structure includes a swing shaft, and a cloth feeding teeth member pivotally disposed on the swing shaft and driven by the swing shaft to perform a horizontal reciprocal movement. The vertical driving structure includes an eccentric shaft connected to the cloth feeding teeth member and driven by a driving motor to drive the cloth feeding teeth member to perform a vertical reciprocal movement, and an eccentric cam disposed on the eccentric shaft and driven by the eccentric shaft to rotate. The direction adjustment structure includes a stepping motor, and an adjustment portion driven by the stepping motor. The adjustment portion includes a rotating shaft pivotally connected to the stepping motor and driven by the stepping motor to rotate and switch between a first position and a second position, a track portion disposed in the rotating shaft, a sliding block disposed in the track portion, and a linkage rod pivotally connected to the swing shaft and the eccentric cam and having one end connected to the sliding block. The linkage rod is driven by the eccentric cam to perform a first swinging displacement and a second swinging displacement when the rotating shaft is at the first position and the second position respectively, such that the sliding block is driven to slide back-and-forth in the track portion. The cloth feeding teeth member performs a forward feeding process when the linkage rod performs the first swinging displacement, and performs a reverse feeding process when the linkage rod performs the second swinging displacement.

In one embodiment, the eccentric shaft includes a main shaft penetrating through the eccentric cam and driven by the driving motor to rotate, a connecting portion pivotally connected to the cloth feeding teeth member, and an auxiliary shaft eccentrically disposed at one end of the main shaft, connected to the connecting portion and driven by the main shaft to allow the cloth feeding teeth member to perform the vertical reciprocal movement.

Through the stepping motor of the present invention, the rotating shaft of the adjustment portion is directly driven to rotate and switch between the first position and the second position, so as to further change movement of the linkage rod to perform the first swinging displacement and the second swinging displacement. Further, the linkage rod changes the position of the cloth feeding teeth member for performing the horizontal reciprocal movement through different swinging displacement. By incorporating the above horizontal reciprocal movement with the vertical reciprocal movement provided by the eccentric shaft, the cloth feeding teeth member can perform forward and reverse feeding processes. Compared to a cloth feeding mechanism of a conventional sewing machine, in which a plurality of connecting rods are connected to control the rotating shaft, the present invention offers simpler operations. In the present invention, the rotating shaft is directly driven by the stepping motor, so that the rotation angle of the rotating shaft can be precisely controlled to enhance adjustment precision, and the sewing quality of the sewing machine can also be improved.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
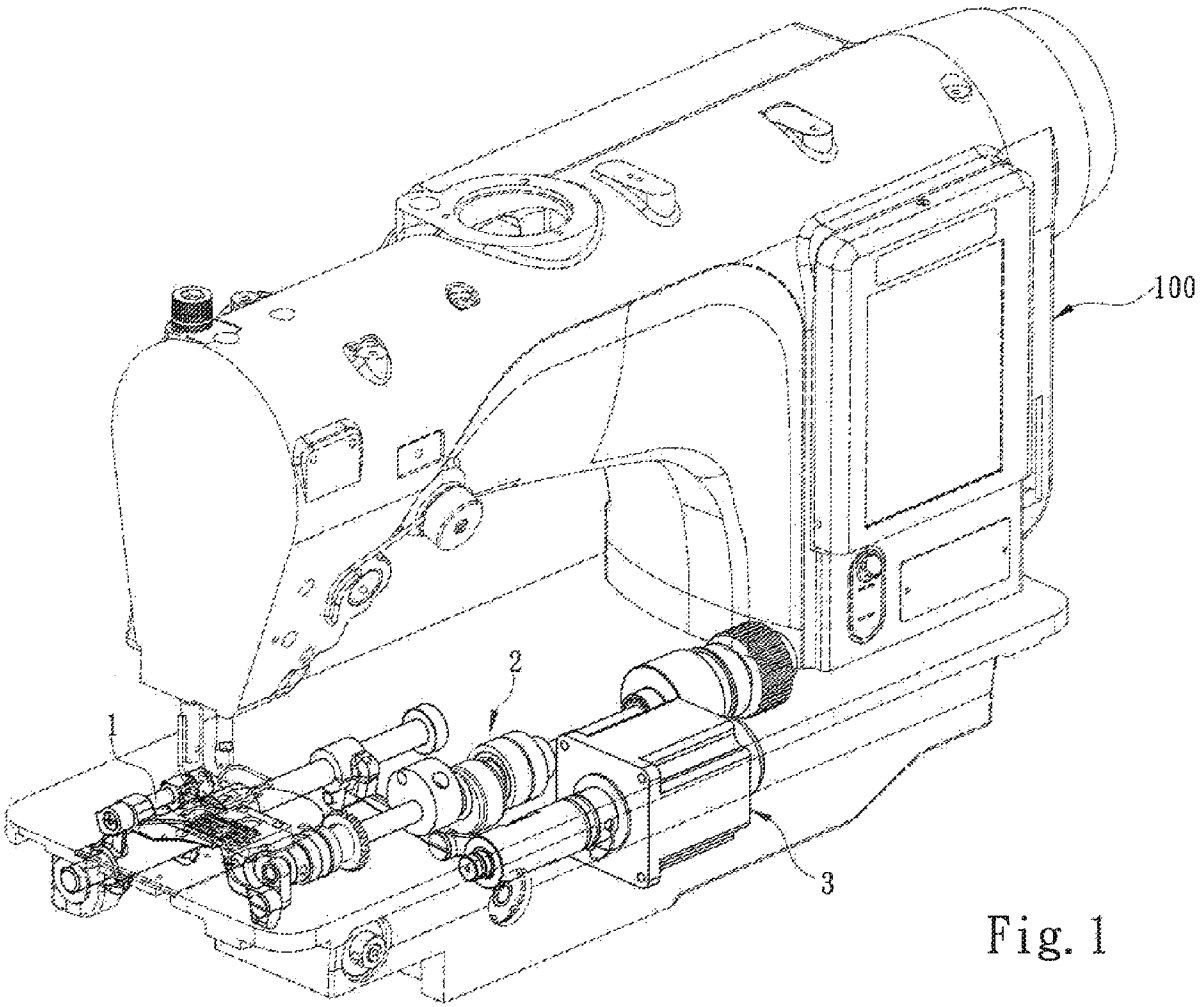
FIG. 1 is an assembly diagram according to a preferred embodiment of the present invention.
Figure 2:
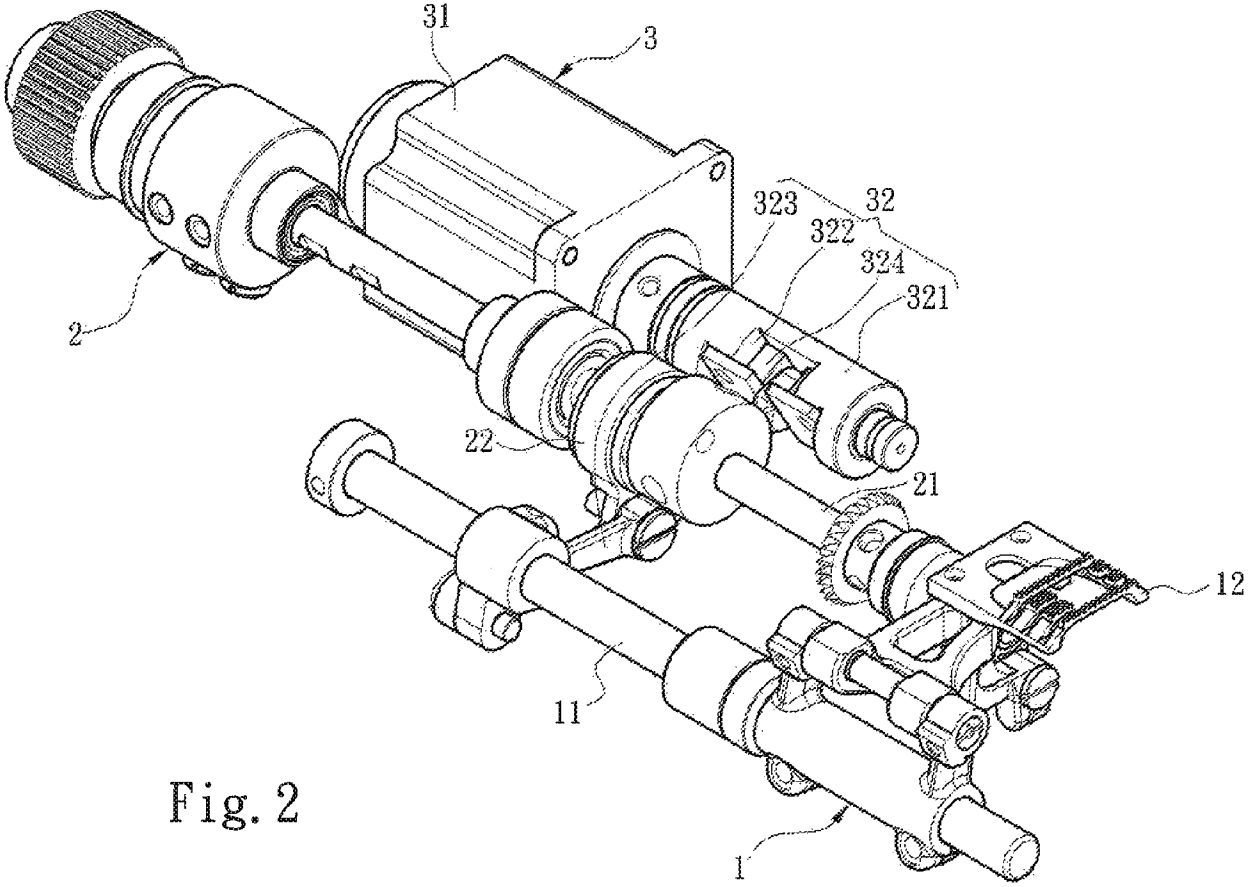
FIG. 2 is a schematic diagram according to a preferred embodiment of the present invention.
Figure 3:
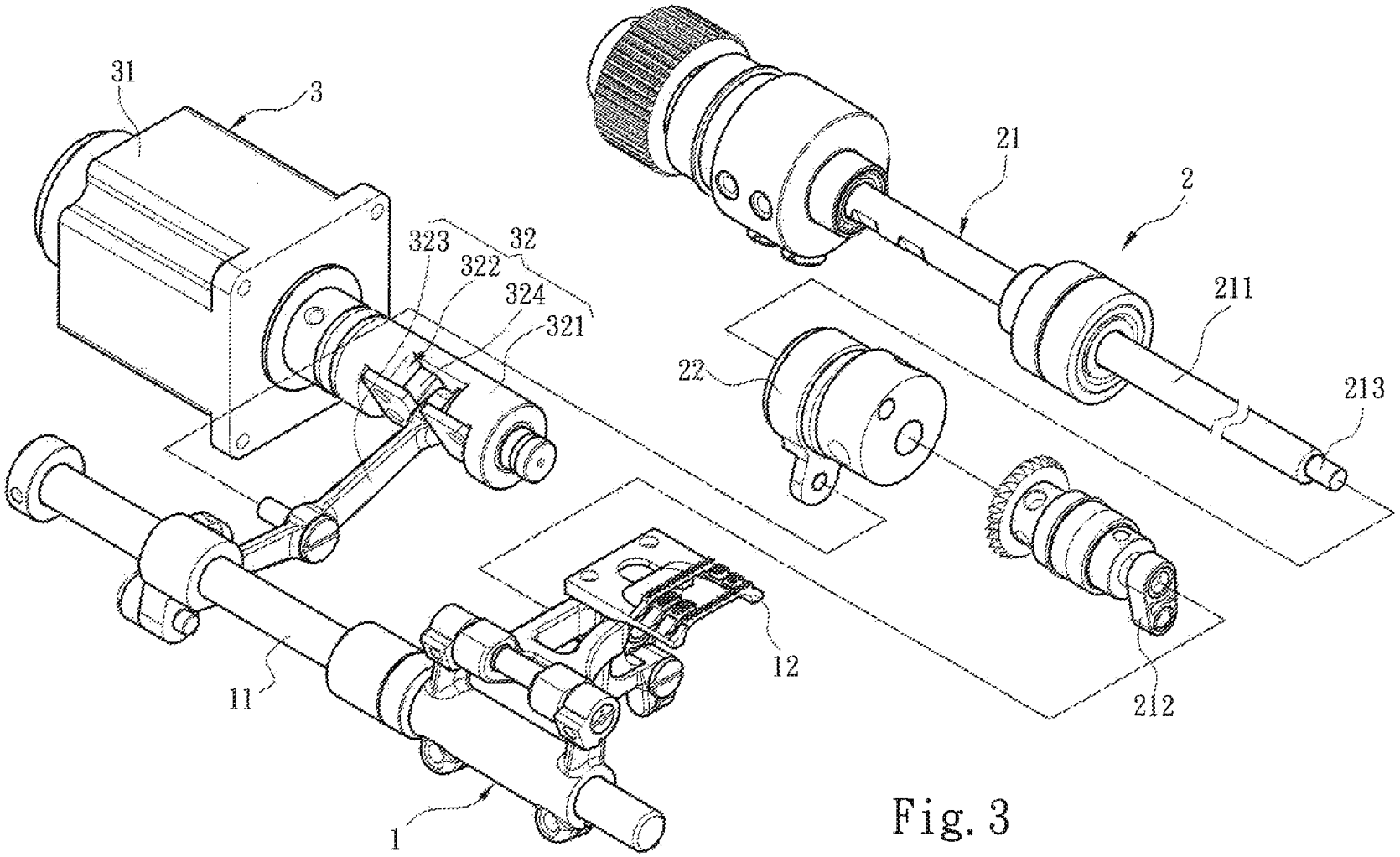
FIG. 3 is an exploded view according to a preferred embodiment of the present invention.

FIGS. 1, 2 and 3 are an assembly diagram, a schematic diagram and an exploded view according to a preferred embodiment of the present invention. Referring to FIGS. 1, 2 and 3, a direct drive cloth feeding mechanism is disposed in a sewing machine 100, and includes a cloth feeding structure 1, a vertical driving structure 2 and a direction adjustment structure 3. The cloth feeding structure 1 includes a swing shaft 11, and a cloth feeding teeth member 12 pivotally disposed on the swing shaft 11 and driven by the swing shaft 11. The vertical driving structure 2 includes an eccentric shaft 21 connected to the cloth feeding teeth member 12 and driven by a driving motor (not shown), and an eccentric cam 22 disposed on the eccentric shaft 21 and driven by the eccentric shaft 21 to rotate. The driving motor is disposed above the eccentric shaft 21, and is driven through a belt to drive the eccentric shaft 21 to rotate. The direction adjustment structure 3 includes a stepping motor 31, and an adjustment portion 32 driven by the stepping motor 31. The adjustment portion 32 includes a rotating shaft 321 pivotally connected to the stepping motor 31 and driven by the stepping motor 31 to rotate and switch between a first position A1 and a second position A2, a track portion 322 disposed in the rotating shaft 321, a sliding block 324 disposed in the track portion 322, and a linkage rod 323 pivotally connected to the swing shaft 11 and the eccentric cam 22, and having one end connected to the sliding block 324. The linkage rod 323 is driven by the eccentric cam 22 to swing and drive the sliding block 324 to slide back-and-forth in the track portion 322. In the present invention, by directly driving the rotating shaft 321 with the stepping motor 31, the rotating shaft 321 pivotally rotates at different angles to drive the cloth feeding structure 1 to perform a forward or reverse feeding process. Associated details are given below.

Figure 4:
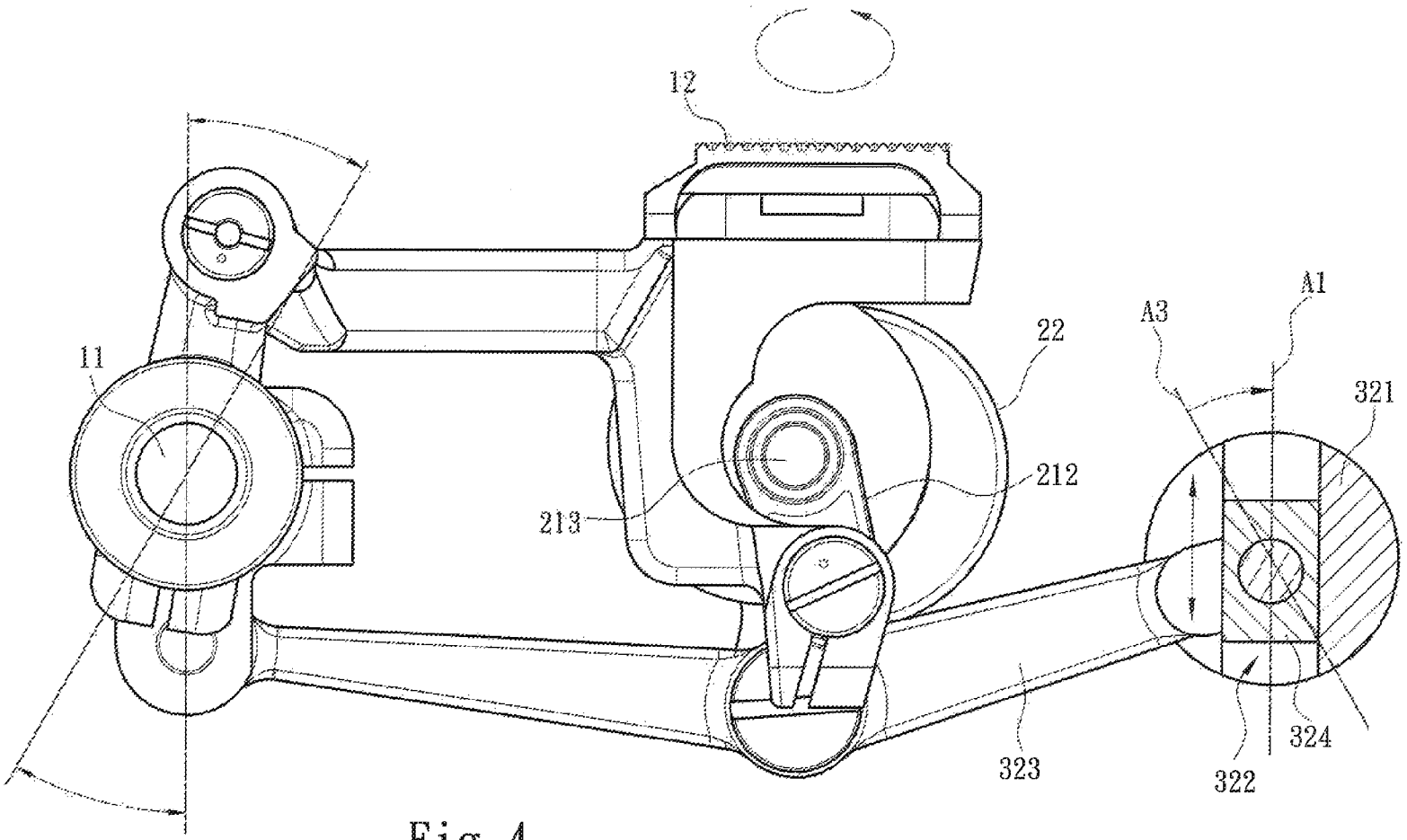
FIG. 4 is a schematic diagram of a forward feeding process according to a preferred embodiment of the present invention.

FIG. 4 shows a forward feeding process of the present invention. Referring to FIG. 4, the eccentric shaft 21 includes a main shaft 211 penetrating through the eccentric cam 22 and driven by the driving motor to rotate, a connecting portion 212 pivotally connected to the cloth feeding teeth member 12, and an auxiliary shaft 213 eccentrically disposed at one end of the main shaft 211, connected to the connecting portion 212 and driven by the main shaft 211. The main shaft 211 is normally driven by the driving motor to maintain clockwise/counterclockwise rotations. The auxiliary shaft 213 eccentrically disposed is also driven by the main shaft 211 to rotate, and drives the cloth feeding teeth member 12 through the connecting portion 212 to provide the cloth feeding teeth member 12 a driving force for moving along a vertical direction. As such, the cloth feeding teeth member 12 performs a vertical reciprocal movement. The vertical direction is coaxial with a center line of a circle formed by a vertical cross-section of the main shaft 211. When the rotating shaft 321 is driven by the stepping motor 31 to locate at the first position A1, the track portion 322 is tilted at an inclined angle, and the eccentric cam 22 is driven by the main shaft 211 to rotate to at the same time drive the linkage rod 323 to pull the sliding block 324 to slide back-and-forth in the track potion 322, thereby the linkage rod 323 performs a first swinging displacement. As the linkage rod 323 is pivotally connected to the swing shaft 11, when the linkage rod 323 performs the first swinging displacement, the swing shaft 11 is driven by the linkage rod 323 to swing back-and-forth and further drive the cloth feeding teeth member 12 to perform the horizontal reciprocal movement. Thus, when the linkage rod 323 performs the first swinging displacement, the cloth feeding teeth member 12 performs the horizontal reciprocal movement at one side of the center line, hence a forward feeding process is formed by incorporating the horizontal reciprocal movement with the vertical reciprocal movement.

Figure 5:
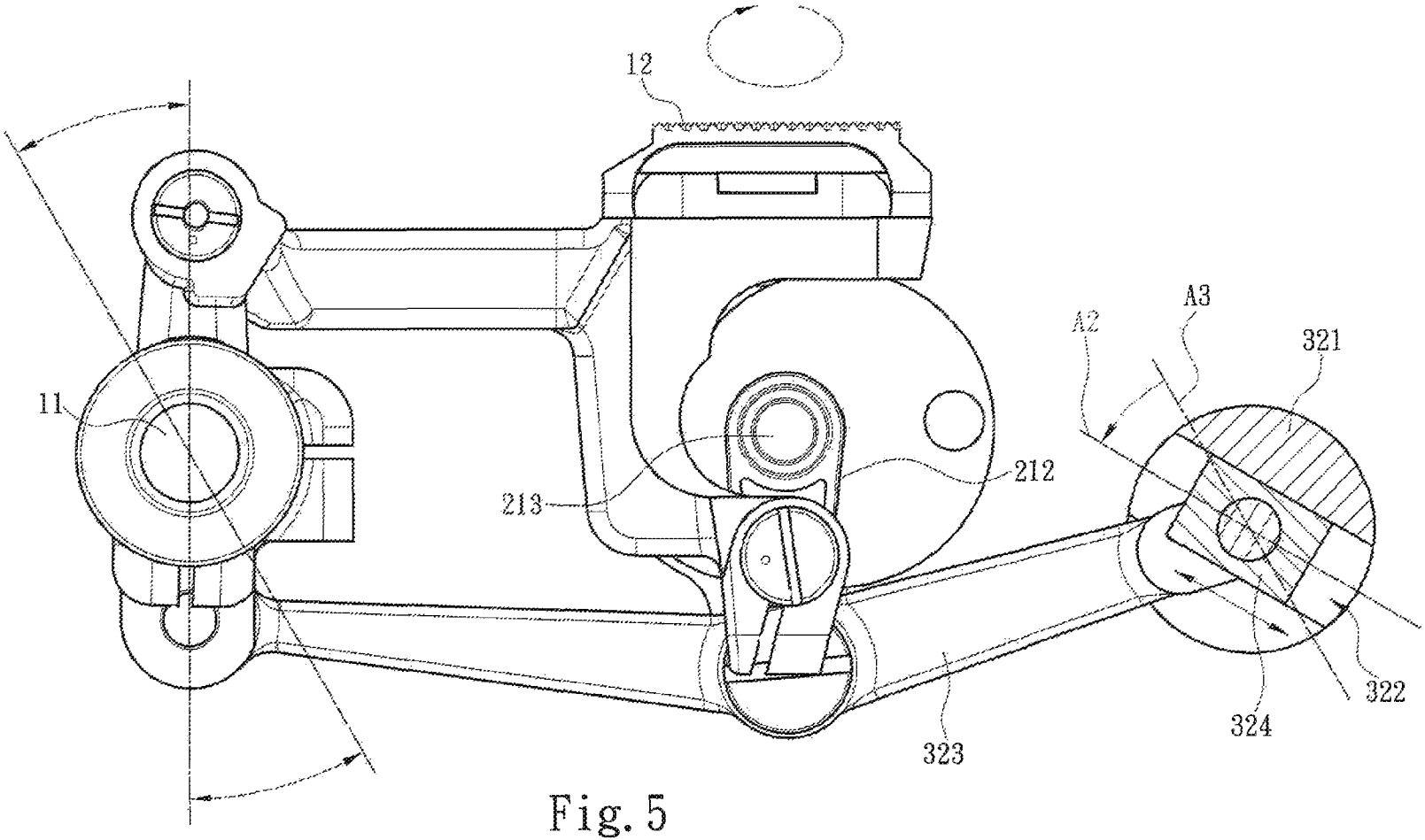
FIG. 5 is a schematic diagram of a reverse feeding process according to a preferred embodiment of the present invention.

FIG. 5 shows a reverse feeding process of the present invention. Referring to FIG. 5, the stepping motor 31 may further be connected to a control unit (not shown). For example, the control unit is a switch, a control interface or a remote control device. Through the control unit, a control signal is transmitted to the stepping motor 31 to make the stepping motor 31 directly drive the rotating shaft 321 of the adjustment portion 32 to rotate at an angle to the second position A2. The control unit may operate in an automatic mode or a manual mode. In the automatic mode, the stepping motor 31 drives the rotating shaft 321 to rotate when a predetermined condition (e.g., a sewing period or a number of sewing stitches) is satisfied. In the manual mode, a user may determine when to drive the stepping motor 31 according to sewing situations. When the rotating shaft 321 is driven by the stepping motor 31 to rotate at an angle to the second position A2, the inclined angle of the track portion 322 is also changed. Thus, an angle at which the sliding block 324 sliding back-and-forth is changed to drive the linkage rod 323 to perform a second swinging displacement. When the swinging mode of the linkage rod 323 changes from the first swinging displacement to the second swinging displacement, the swing shaft 11 is driven to change the swinging angle thereof and further drive the cloth feeding teeth member 12 to change a position of the horizontal reciprocal movement thereof. Further, when the linkage rod 323 performs the second swinging displacement, the cloth feeding teeth member 12 performs the horizontal reciprocal movement at the other side of the center line, and the main shaft 211 is still driven by the driving motor to rotate in the same direction. Meanwhile, the auxiliary shaft 213 eccentrically disposed is continually driven by the main shaft 211 to rotate, and drives the cloth feeding teeth member 12 through the connecting portion 212 to provide the cloth feeding teeth member 12 with a driving force along the vertical direction to perform the vertical reciprocal movement. Thus, a reverse feeding process is formed by incorporating the horizontal reciprocal movement at the other side of the center line with the vertical reciprocal movement.

Since the stepping motor 31 is capable of precisely controlling the rotation angle of the rotating shaft 321, by adjusting the rotation angle of the rotating shaft 321, the displacement of the sliding block 324 sliding back-and-forth in the track portion 322 may be further adjusted. As the rotation angle of the rotating shaft 321 gets larger, i.e., as the inclined angle of the track portion 322 gets larger, the displacement of the sliding block 324 sliding back-and-forth in the track portion 322 becomes shorter to increase a cloth feeding speed of the cloth feeding teeth member 12. Under a same sewing speed, a stitch length sewn by a sewing needle (not shown) on the cloth becomes smaller. On the contrary, as the rotation angle of the rotating shaft 321 gets smaller, i.e., as the inclined angle of the track portion 322 gets smaller, the displacement of the sliding block 324 sliding back-and-forth in the track portion 322 becomes longer to reduce the cloth feeding speed of the cloth feeding teeth member 12. Under the same sewing speed, the stitch length sewn by the sewing needle of the sewing machine 100 on the cloth becomes larger. Therefore, with the stepping motor 31, the present invention is capable of controlling the stitch length of the sewing machine 100, and offers a simpler operation compared to a conventional sewing machine that can only adjust the stitch length through a button.

The stepping motor 31 of the present invention is further capable of driving the rotating shaft 321 to rotate to a third position A3 that is between the first position A1 and the second position A2. More specifically, the third position A3 is an original point. When the rotating shaft 321 is located at the third position A3, movement of the linkage rod 323 driven by the eccentric cam 22 are counteracted with movement of the linkage rod 323 driven by the sliding block 324 sliding in the track portion 322. As such, the linkage rod 323 does not drive the swing shaft 11 to rotate, in a way that the cloth feeding teeth member 12 remains at a still state. Hence, the stepping motor 31 may freely control the rotating shaft 321 to switch among the first position A1, the second position A2 and the third position A3, so as to control the cloth feeding teeth member 12 to perform the forward, reverse and still feeding processes.

Through the stepping motor 31 of the present invention, the rotating shaft 321 of the adjustment portion 32 is directly driven to rotate and switch between the first position A1 and the second position A2, so as to further change movement of the linkage rod 323 to perform the first swinging displacement and the second swinging displacement. Further, the linkage rod 323 changes the position of the cloth feeding teeth member 12 for performing the horizontal reciprocal movement through different swinging displacement. By incorporating the above horizontal reciprocal movement with the vertical reciprocal movement provided by the eccentric shaft 21, the cloth feeding teeth member 12 can perform forward and reverse feeding processes. Compared to a cloth feeding mechanism of a conventional sewing machine, in which a plurality of connecting rods are connected to control the rotating shaft, the present invention offers simpler operations. In the present invention, the rotating shaft 321 is directly driven by the stepping motor 31, so that the rotation angle of the rotating shaft 321 can be precisely controlled to enhance adjustment precision, and the sewing quality of the sewing machine 100 can also be improved.

What is claimed is:

1. A direct drive cloth feeding mechanism of a sewing machine, comprising:

a cloth feeding structure, comprising a swing shaft, and a cloth feeding teeth member pivotally disposed on the swing shaft and driven by the swing shaft to perform a horizontal reciprocal movement;

a vertical driving structure, comprising an eccentric shaft connected to the cloth feeding teeth member and driven by a driving motor to drive the cloth feeding teeth member to perform a vertical reciprocal movement, and an eccentric cam disposed on the eccentric shaft and driven by the eccentric shaft to rotate; and a direction adjustment structure, comprising:

a stepping motor; and an adjustment portion, driven by the stepping motor, comprising a rotating shaft pivotally connected to the stepping motor and driven by the stepping motor to rotate and switch between a first position and a second position, a track portion disposed in the rotating shaft, a sliding block disposed in the track portion, and a linkage rod pivotally connected to the swing shaft and the eccentric cam and including one end connected to the sliding block; wherein the linkage rod is driven by the eccentric cam to perform a first swinging displacement and a second swinging displacement when the rotating shaft is at the first position and the second position respectively such that the sliding block is driven to slide back-and-forth in the track portion;

wherein the cloth feeding teeth member performs a forward feeding process when the linkage rod performs the first swinging displacement, and a reverse feeding process when the linkage rod performs the second swinging displacement;

wherein the eccentric shaft comprise a main shaft penetrating through the eccentric cam and driven by the driving motor to rotate, a connecting portion pivotally connected to the cloth feeding teeth member, and an auxiliary shaft eccentrically disposed at one end of the main shaft, connected to the connecting portion, and driven by the main shaft to allow the cloth feeding teeth member to perform the vertical reciprocal movement.

* * * * *